United States Patent [19]

Engblom

[11] Patent Number: 4,572,155

[45] Date of Patent: Feb. 25, 1986

[54] CONVERGENT FLOW STOVE

[76] Inventor: David W. Engblom, 928 N. Kaspar Ave., Arlington Heights, Ill. 60004

[21] Appl. No.: 667,083

[22] Filed: Nov. 1, 1984

Related U.S. Application Data

[63] Continuation-in-part of Ser. No. 605,072, Apr. 30, 1984, abandoned.

[51] Int. Cl.[4] ..... F24B 5/00

[52] U.S. Cl. ..... 126/76; 126/77; 126/146; 126/163 R

[58] Field of Search ..... 126/75, 76, 77, 58, 126/60, 61, 80, 103, 163 A, 152 R, 224, 225, 144-151; 110/298-300

[56] References Cited

U.S. PATENT DOCUMENTS

| | | | |
|---|---|---|---|
| 649,154 | 5/1900 | Baughman | 126/77 |
| 4,480,630 | 11/1984 | Wilhoite | 126/61 |

FOREIGN PATENT DOCUMENTS

| | | | |
|---|---|---|---|
| 749647 | 7/1933 | France | 126/99 C |
| 880846 | 4/1943 | France | 126/77 |
| 65033 | 7/1939 | Norway | 126/76 |
| 111352 | 8/1944 | Norway | 126/76 |

*Primary Examiner*—James C. Yeung
*Attorney, Agent, or Firm*—Lee, Smith & Zickert

[57] ABSTRACT

A stove for burning combustible solid organic material, such as wood. The stove has a vertical fuel chamber with a combustion zone in the lower portion of the fuel chamber which is defined by an air inlet passage across the width of the fuel chamber and a convergent outflow passage at the bottom of the chamber. The combustion zone is shaped to provide a wedge-shaped area of incandescent coals during combustion in the combustion zone. No grate or other retention apparatus is needed in addition to the convergent outflow passage in order to retain fuel in place as it is consumed. The stove may be configured to provide radiant heat, as a forced air furnace, or as a boiler, or any combination of the three.

6 Claims, 16 Drawing Figures

CONVERGENT FLOW STOVE

RELATED APPLICATION

This application is a continuation-in-part of my copending application Ser. No. 605,072, filed Apr. 30, 1984 and now abandoned.

BACKGROUND OF THE INVENTION

This invention relates to stoves, such as wood stoves, and in particular to a convergent flow stove in which combustion occurs only in a defined area at the bottom of the stove with the combustion and products of combustion being directed downwardly through an outflow passage.

Wood-burning stoves are well-known, having often, in the past, been a main, if not only source of heat in homes. With the advent of modern gas and oil-dried boilers and furnaces, wood stoves became less common, until recent years when dramatically increasing fuel costs led to a resurgence of demand for wood stoves which consume fuel such as wood which is abundant, renewable and often cheaper than the gas or oil it replaces or supplements.

A typical wood stove has a vertical combustion chamber, with an outlet flue at the top of the combustion chamber and a combustion air inlet at the bottom of the combustion chamber. When the combustion chamber is charged with wood and combustion initiated, combustion occurs in the normal upward direction throughout the entire charge of wood. Characteristically, operation of such stoves is smokey and the heating output is unsteady.

Recognizing the unsatisfactory operating characteristics of the typical wood stove many efforts in the past have been made to direct combustion gases downwardly through the zone of incandescent coals to promote combustion of gases and lower the temperatures of the fuel above the incandescent zone. These efforts have been moderately successful in achieving steady, smokeless operation. Typically, however, steady firing has been hindered by the accumulation of ash in the incandescent zone, which causes firing to drop off. A grate is usually provided so that the ash can periodically be "shaken out" to revive the fire. In addition, "down draft" stoves have been just as smokey as typical stoves at low heating outputs. The probable reason is that because of the reduced volume of incandescent coals at low heating outputs the coals are too dispersed on the grate to effectively ignite the gases passing through.

One example of the prior art, U.S. Pat. No. 4,194,487, discloses an apparatus that directs combustion downwardly, but which would not have a steady heating output because of ash accumulation, nor good combustion at low heating outputs because the reduced volume of coals is divided into two separate parts not mutually supportive in maintaining ignition temperatures for the gases passing through.

U.S. Pat. No. 4,102,318 discloses another down draft apparatus that would not promote complete combustion at low heating outputs since the grate bars prevent the reduced volume of coals from compacting at the outlet in sufficient density to assure temperatures necessary for ignition of the gases. It should also be noted that at low heating outputs, depending on the width of the clearance between the separator plate 19 and the side walls, it is probable that all the flow of combustion gases is upwards, as in a typical stove.

U.S. Pat. No. 253,144 discloses a stove for coal burning that has a vertical cylindrical configuration. Although a grate is not used, and no net accumulation of ashes would be expected in the combustion zone, it is probable that steady, smokeless combustion could not be achieved by firing wood logs. Because of the central metering and air introduction shaft, the logs would need to be inserted on end into the annular fuel chamber. Logs on end tend to burn to a point, presenting less surface area, with the consequence that firing drops off. Also, logs do not slide past each other, with the consequence that the slowest burning log (usually the one with the thickest cross section) could hold other logs up, again causing firing to drop off. Because the central metering and air introduction shaft is employed, much of the useful space in the fuel chamber is occupied, and the downward migration of the fuel is constricted with the result that fuel can also bridge within the fuel chamber without entering the combustion area. In this case also, the reduced volume of coals at low heating outputs is separated by the flared bottom of the central shaft and dispersed radially making it probable that sufficient temperatures could not be maintained to assure combustion of the gases.

SUMMARY OF THE INVENTION

The present invention is an improved apparatus for burning combustible solid organic material, such as wood, in an environment in which combustion is directed downwardly. The invention includes a fuel chamber having a closed upper portion and a major dimension in the vertical direction such that the fuel chamber is generally upright. A combustion zone is provided in the lower portion of the fuel chamber and in one form of the invention is defined by an air inlet passage in the fuel chamber across the top of the combustion zone and a convergent outflow passage at the bottom of the fuel chamber. The combustion zone is configured to provide a wedge-shaped area of incandescent coals during combustion in the combustion zone. The outflow passage comprises a generally horizontally extending open slot spanning the width of the fuel chamber. The air inlet passage extends generally parallel to the outflow passage.

In accordance with a first form of the invention, the combustion zone comprises a front wall, a rear wall, and opposite vertical side walls. At least one of the front and rear walls is sloped toward the outflow passage to provide the wedge-shaped area. The outflow passage comprises a gap between the front and rear walls. No grate or other auxiliary device is used to retain the logs or incandescent coals in place. Preferably, the angle of slope of the sloped wall is a minumum of approximately 30° and is typically up to 60° to assure proper ash and coal migration toward the outflow passage.

Both the front and rear walls can be sloped toward one another. A horizontal outflow passage can therefore be formed between the two walls, or the rear wall can be vertically offset from the front wall so that the slot is oriented at an inclination between the front and rear walls.

In the first form of the invention, the air inlet is located at the top of the front wall. The inlet can comprise a series of spaced holes, and various means of controlling flow of air through the air inlet passage may be provided, such as a constricting flap or an apertured slide.

Also in the first form, a flue outlet communicates with the slot, the outlet extending the width of the slot. The outlet comprises a plurality of spaced, vertically hollow sections extending upwardly adjacent the slot. Vertical ribs extend between the sections into the fuel chamber with the ribs providing means to retain the sections in place.

Because combustion is at the bottom of the fuel chamber, in all embodiments a fuel loading door is located in the upper portion thereof. A normally closed by-pass damper is also located at the top of the upper portion of the fuel chamber and may be opened to provide a temporary flue outlet from the fuel chamber such that combustion in the fuel chamber is directed upwardly.

In a second form of invention, rather than a single air inlet passage, air is provided through a series of slots formed in opposite walls of the combustion zone of the fuel chamber. The slots are spaced from one another and are situated in rows, with the slots of each row communicating with a lateral air channel extending to a source of air for the fuel chamber. Also in this form of the invention, the flue outlet comprises a plurality of spaced, parallel tubes which are juxtaposed the inlet slots and which are perpendicular to the air channels communicating with the slots. Preferably, the slots, air channels and flue tubes are formed in a single hearth element which forms part of the wall of the combustion zone of the fuel chamber.

BRIEF DESCRIPTION OF THE DRAWINGS

The invention is described in further detail in the following description of examples embodying the best mode of the invention, taken in conjunction with the drawings, in which.

DESCRIPTION OF EXAMPLES EMBODYING BEST MODE OF THE INVENTION

Figure 1:
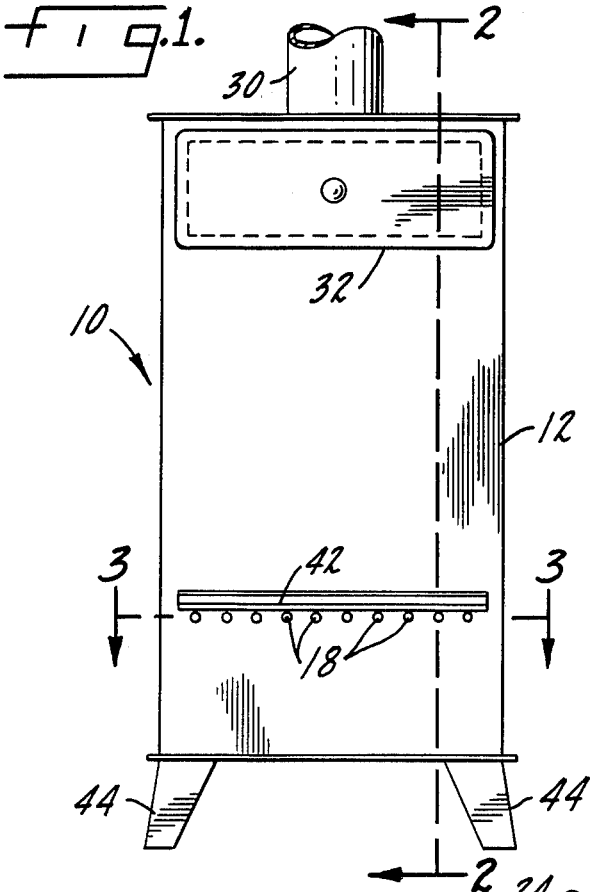
FIG. 1 is a front elevational illustration of a first embodiment of a first form of the invention.
Figure 2:
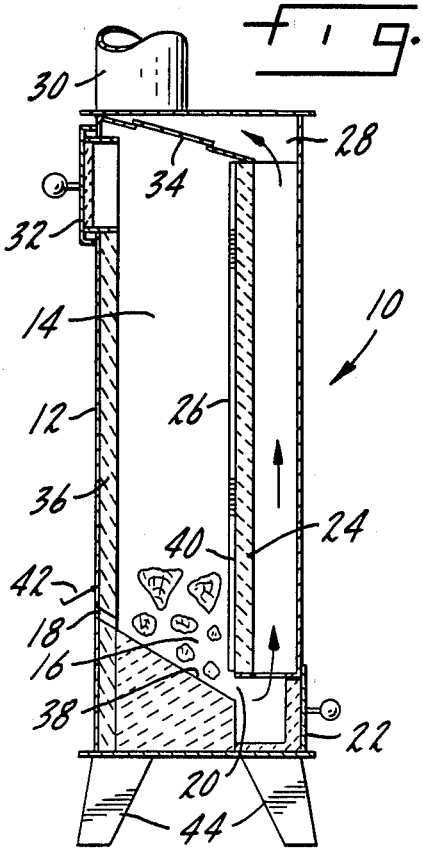
FIG. 2 is a vertical cross-sectional illustration taken along lines 2—2 of FIG. 1.
Figure 3:
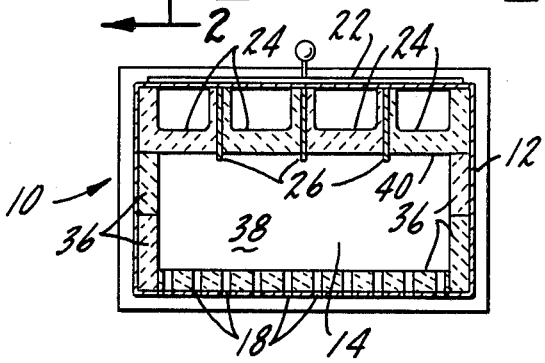
FIG. 3 is a horizontal cross-sectional configuration viewed in the downward direction taken along lines 3—3 of FIG. 1.

A first embodiment of a first form of invention, designated generally at 10, is shown in FIGS. 1-3. The stove 10 includes an outer shell 12 housing an interior, vertical fuel chamber 14. The fuel chamber 14 is closed in its upper portion to prevent combustion of fuel loaded therein.

The fuel chamber 14 includes a combustion zone 16 in the lower portion thereof defined by an air inlet passage comprising a plurality of spaced holes 18 extending across the top of the combustion zone 16 and a convergent outflow passage 20 in the shape of a slot at the bottom of the fuel chamber 14. As shown in cross section in FIG. 2, the combustion zone 16 is configured to provide a wedge-shaped area of incandescent coals during combustion in the combustion zone, with ash exiting the combustion zone 16 through the convergent outflow passage 20 into an ash receptacle having a clean-out door 22.

As shown, the air inlet passage 18 extends across the width of the fuel chamber 14. The outflow passage 29 extends horizontally, also across the width of the fuel chamber 14, and is opened along its entire length.

Gaseous products of combustion from the combustion zone 16 exit through the slot of the outflow passage 20 into a flue outlet comprising a plurality of spaced, vertically hollow flue sections 24 extending upwardly from the outflow passage 20. As best shown in FIG. 3, vertical ribs 26 extend between the flue sections 24 into the fuel chamber 14 to retain the flue sections 24 in place. Additionally, the ribs 26 project sufficiently far into the interior of the fuel chamber 14 to absorb impact of logs during fueling of the stove 10. The flue sections 24 extend to an upper plenum 28 to which is connected a duct or chimney 30 for exhaustion of combustion gases.

A sealed fuel loading door 32 is provided at the top of the fuel chamber 14. As shown in FIG. 1, the fuel loading door 32 extends across the width of the fuel chamber 14 to facilitate insertion of logs having a length approximately equal to the width of the fuel chamber 14. A by-pass damper 34 is also provided at the top of the fuel chamber 14 and may be moved to one side (means not shown) to permit temporary upperward combustion in the fuel chamber 14 during initial firing of a charge of fuel therewithin.

The fuel chamber 14 is lined with a conventional, hard, high temperature refractory lining 36. The flue sections 24 are, preferrably, constructed of the same material. The same is true for all embodiments of the invention.

The combustion zone 16 has a sloped front wall 38, a rear wall 40, and vertical sides defined by the opposite sides of the fuel chamber 14. The front wall 38 is sloped toward the outflow passage 20, with the outflow passage comprising a gap between the front wall 38 and the rear wall 40. The slope of the front wall 38 is a minimum of approximately 30°.

An air shutter 42 is hingedly secured to the shell 12 in order to control the air flow through the holes 18. Alternatively, a conventional slide having holes aligned with the holes 18 can be employed, with the slide being displaced to reduce the inlet aperture of each of the holes 18 to control air flow.

During use, the outer shell 12 becomes quite hot and radiates heat to the surrounding atmosphere. Legs 44 are provided to raise the stove above the surface upon which it sits to promote air circulation and prevent inadvertent combustion if the stove 10 should be located upon a combustible surface.

Figure 4:
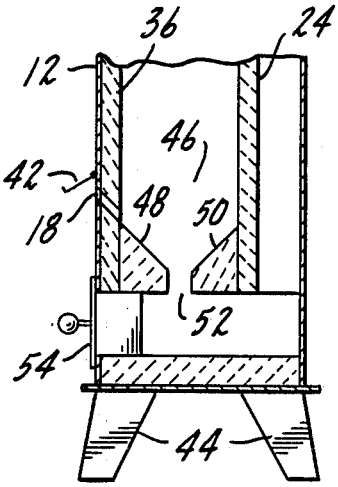
FIG. 4 is a cross-sectional illustration of a fragmentary portion of a second embodiment of the first form of the invention illustrating a different outlet configuration for the fuel chamber.

FIG. 4 illustrates an alternative embodiment of the first form of the invention with a different configuration for the combustion zone. Otherwise, the components illustrated are identical to those illustrated and described in connection with FIGS. 1–3, and therefore these components bear the same reference numerals and will not be described further.

In FIG. 4, the combustion zone 46 includes a sloping front wall 48 and a sloping rear wall 50. The walls 48 and 50 converge toward an outflow passage or slot 52 which is in communication with the flue sections 24. In this embodiment of the invention, an ash clean-out door 54 is located at the front of the stove.

Figure 5:
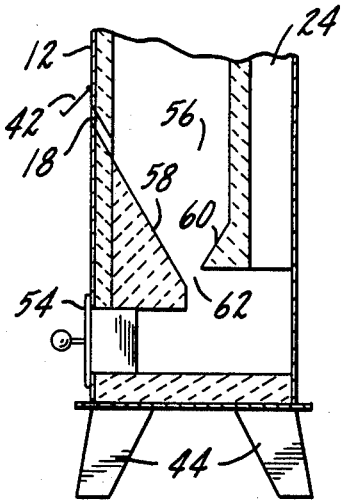
FIG. 5 is an illustration similar to FIG. 4 showing yet another embodiment of the first form of the invention.

A second alternative embodiment of the first form of the invention is shown in FIG. 5. Again, identical elements bear the same reference numerals and are not described further. In this embodiment, the combustion zone 56 is formed by sloping respective front and rear walls 58 and 60 which are offset from one another and which converge toward an outflow passage 62 which is oriented at an inclination between the front and rear walls 58 and 60.

Figure 6:
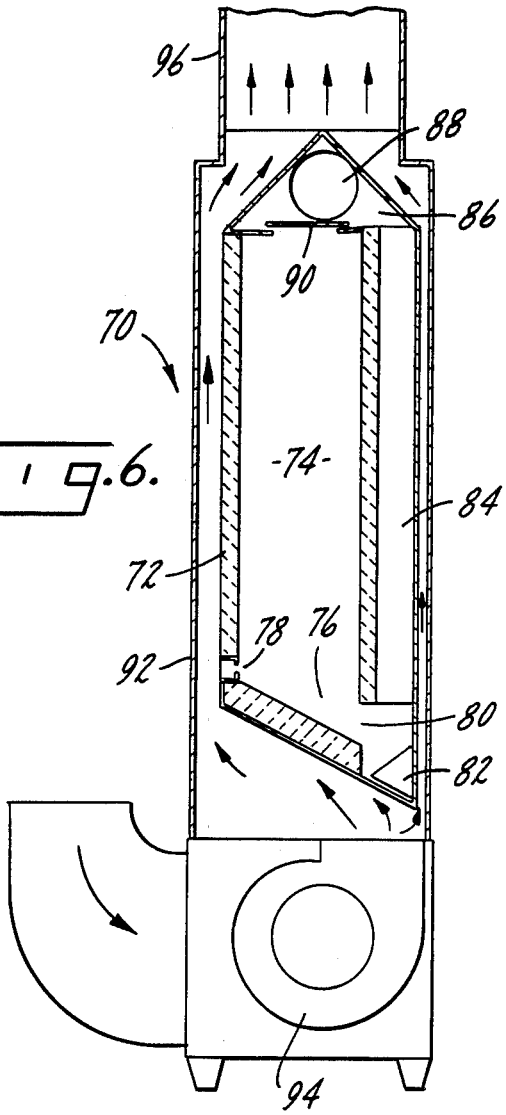
FIG. 6 is a cross-sectional, side elevational illustration of an alternative embodiment of the first form of the invention when employed as a forced-air furnace.
Figure 7:
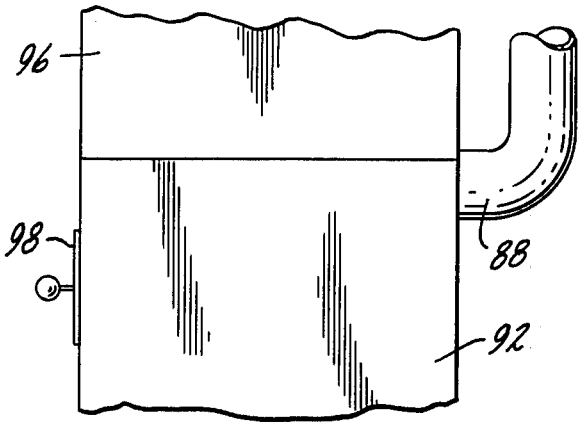
FIG. 7 is a front (or rear) partial elevation illustration of the embodiment of FIG. 6 showing the location of the flue outlet and fuel inlet.

The first form of the invention is shown configured as a forced-air furnace 70 in FIGS. 6 and 7. Similar to the embodiments of FIGS. 1 through 5, the furnace 70 includes an internal stove 72 having a vertical fuel chamber 74 and a lower combustion zone 76 defined by an air inlet passage 78 and a convergent outflow passage 80. The air inlet passage is connected to an external air source (not illustrated) and, if necessary, a blower can be attached to the passage 78 to assure an adequate air supply. An ash clean-out door 82 is located at either end of the stove 72 and a screw auger (not illustrated) may be employed to convey ash to the clean-out door 82. Flue sections 84 extend upwardly from the outflow passage 80 to an upper plenum 86 connected to a flue collar and flue 88 leading to a chimney (not illustrated). As in the embodiment of FIGS. 1–3, a bypass damper 90 is employed to promote initial firing within the fuel chamber 74.

The entire stove 72 is encased within a furnace shell 92. A centrifugal circulating air blower 94 circulates air about the stove 72 to a warm air supply duct 96. Air flow about the stove 72 within the furnace shell 92 is indicated by airflow arrows throughout the illustration in FIG. 6.

Fuel may be loaded into the fuel chamber 74 from either end thereof. As shown in FIG. 7, a fuel loading door 98 is provided to communicate with the top of the fuel chamber 74 for fueling purposes.

Figure 8:
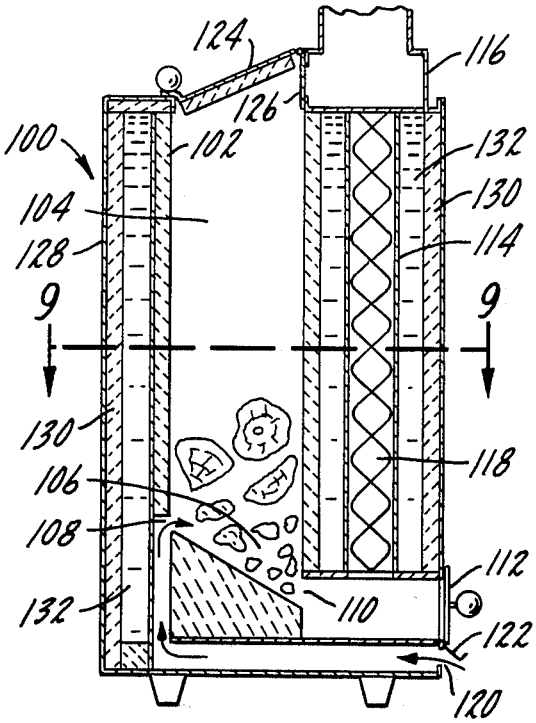
FIG. 8 is a cross-sectional, side elevational illustration of another embodiment of the first form of the invention when employed as a boiler.
Figure 9:
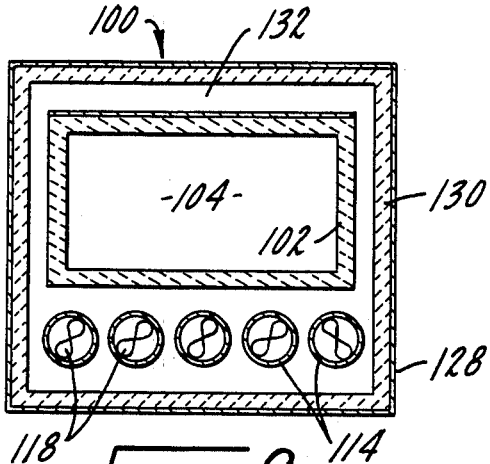
FIG. 9 is a cross sectional illustration taken in the downward direction along lines 9—9 of FIG. 8.

A final embodiment of the first form of the invention is illustrated in FIGS. 8 and 9 in the form of a boiler 100. Similar to the earlier embodiments of the invention, an internal stove 102 is provided with a fuel chamber 104 and has a lower combustion zone 106 defined by an air inlet passage 108 and a convergent outflow passage or slot 110. A clean-out door 112 is provided to remove ash from the base of the stove 102, and a series of cylindrical flue sections 114, connected to upper breaching 116, lead to a chimney (not illustrated). Each of the flue sections 114 includes a swirling member 118 to enhance heat transfer from escaping flue gases to the boiler 100. Combustion air for the air inlet 108 enters through an inlet 120 whose aperture is controlled with a shutter 122.

Loading of the fuel chamber 104 is through a sealed fuel loading door 124. As in the prior embodiments of the invention, a bypass damper 126 is provided for initial firing of the fuel chamber 104.

The stove 102 is surrounded by a boiler shell 128 spaced from the stove 102 to form a water jacket for water within the boiler 100. The shell 128 may include insulation 130 if heat radiation to the surrounding environment is not desired. Water 132 fills the area between the boiler shell 128 and the stove 102. As is conventional, the water 132 pumped (pump not illustrated) to convectors or radiators in remote locations to be heated.

A second form of the invention is shown generally at 150 in FIGS. 10 through 16. This form of the invention is similar in concept to the embodiments of the form shown in FIGS. 1 through 9, but instead of having a single air inlet at the top of the combustion zone, air is introduced into the combustion zone at a plurality of locations. In function, this form of the invention is basically the same as that of the embodiments of FIGS. 1 through 9, and although the form of the invention illustrated is that of a forced-air furnace, it is evident that this form of the invention can serve also as a boiler or a convection heating device, in a manner similar to that discussed above.

Figure 10:
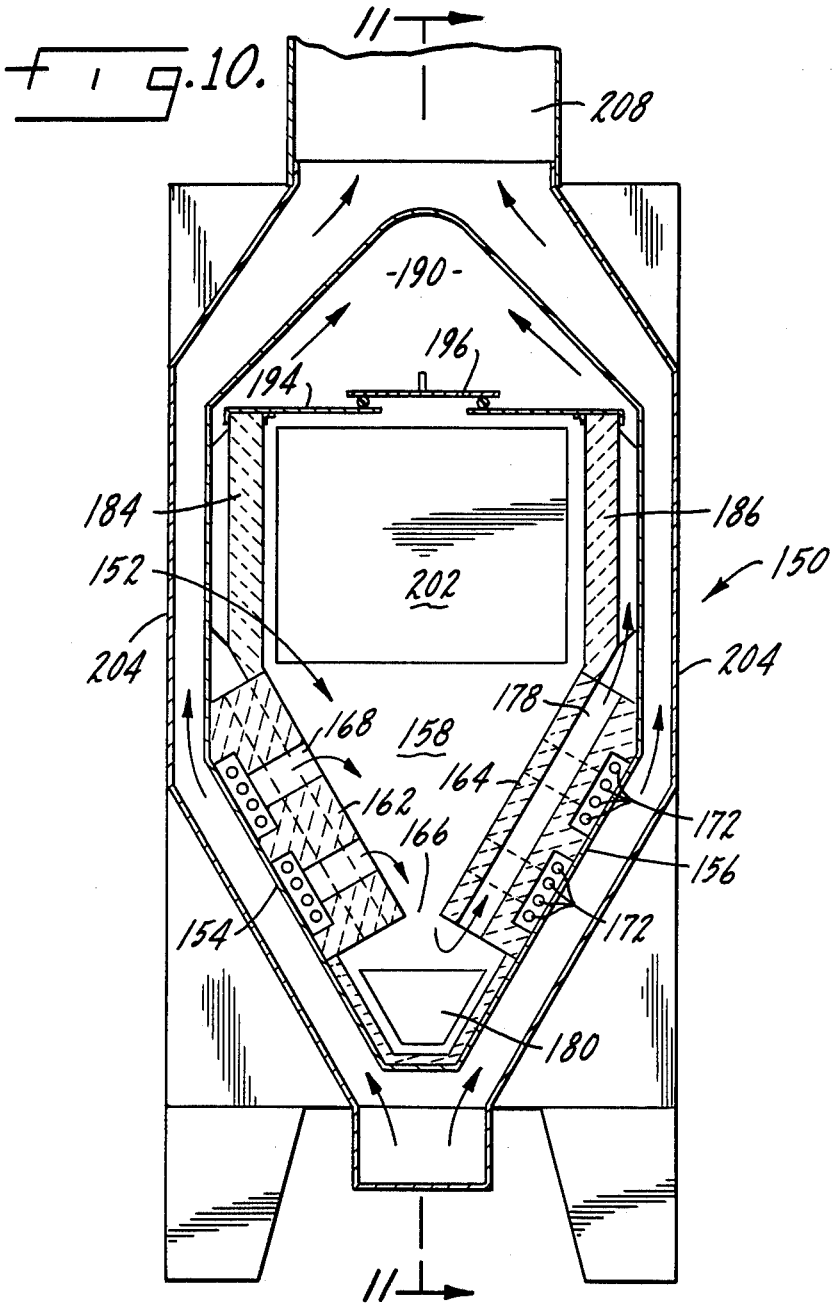
FIG. 10 is a rear cross-sectional elevational illustration of a second form of the invention having a slightly different air inlet and flue outlet configuration.
Figure 12:
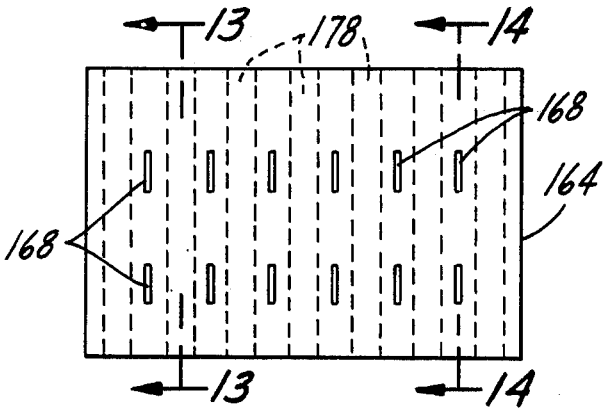
FIG. 12 is a top view of either the left or right side (FIG. 10) hearth elements of this form of the invention.
Figure 13:
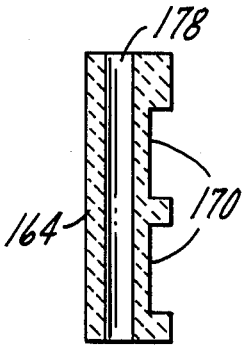
FIG. 13 is a cross-sectional illustration taken along lines 13—13 of FIG. 12.
Figure 14:
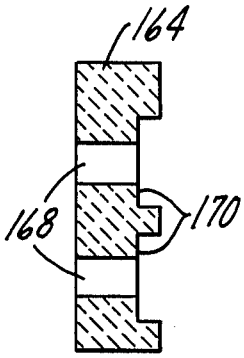
FIG. 14 is a cross-sectional illustration taken along lines 14—14 of FIG. 12.
Figure 11:
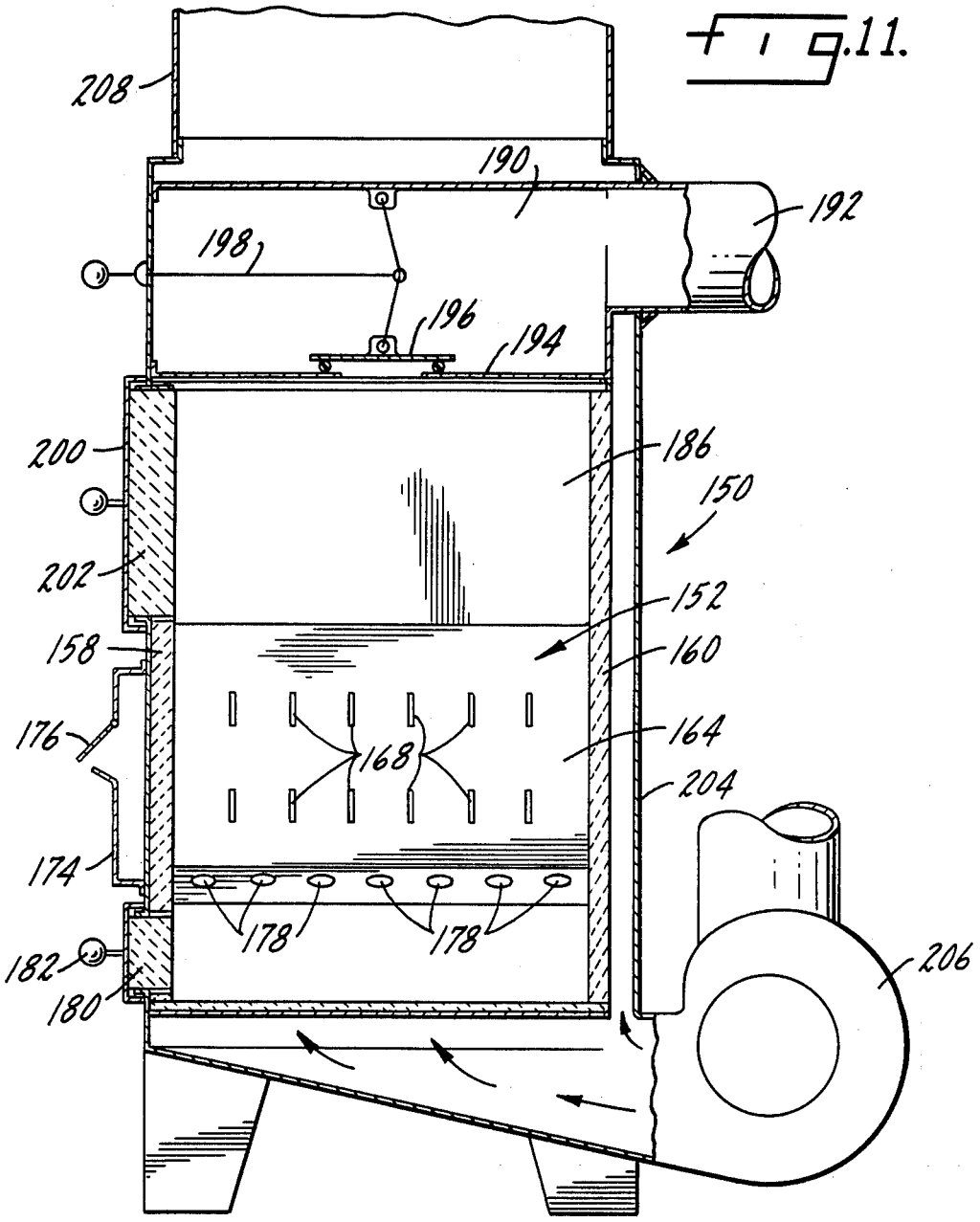
FIG. 11 is a cross-sectional illustration taken along the lines 11—11 of FIG. 10.
Figure 15:
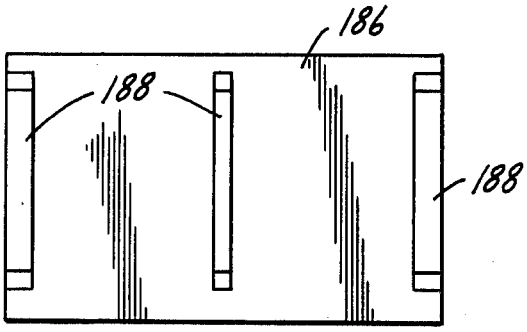
FIG. 15 is a rear view of one of the upper flue elements of the form of the invention shown in FIG. 10.
Figure 16:
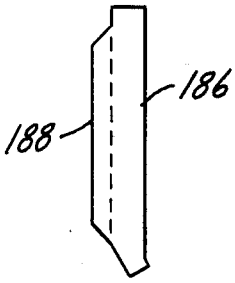
FIG. 16 is a side elevational illustration of the flue element shown in FIG. 15.

This form of the invention includes a sealed fuel chamber 152. The lower portion of the fuel chamber 152, where combustion occurs, is defined by opposite side walls 154 and 156, and front and rear walls 158 and 160. The side walls 154 and 156 include respective hearth elements 162 and 164 which, as shown in FIG. 10, converge towards one another to form a convergent outflow passage 166. The elements 162 and 164 are identical, and although the element 164 is discussed in relation to FIGS. 12 through 14, it is apparent that the element 162 would be identical. The hearth element 164 is of a unitary construction and includes a series of parallel slots 168 formed in two parallel rows. As best shown in FIG. 14, the slots 168 extend through the depth of the hearth element 164 and are connected to a channel 170 which runs laterally along the back of the hearth element 164, and when installed, seats on the side wall 156. The channels 170 terminate at an air inlet aperature which comprises a series of holes 172 in the front of the stove which are open to the atmosphere. As shown in FIG. 11, the holes 172 may open into a combustion air plenum 174 having a damper 176 to control the amount of combustion air permitted to enter the channels 170 and be distributed through the slots 168 to the burning wood (not illustrated). Alternatively, a slide arrangement or other means of controlling air flow through the holes 172 can be provided to meter the amount of air that is ultimately introduced into the fuel chamber 152.

The hearth element 164 also serves as the initial flue outlet from the fuel chamber 162. As illustrated, the hearth element 164 includes a plurality of tubes 178 which are spaced between the slots 168. Thus, air is introduced into the fuel chamber 152 through the slots 168, while products of combustion are simultaneously withdrawn downwardly through the outflow passage 166 and out through the tubes 178.

An ash drawer 180 is located directly beneath the outflow passage 166. Ash drops into the drawer 180 during combustion, and the drawer itself may be removed from the front of the stove 150 for cleaning by means of a handle 182 attached to the ash drawer 180.

Opposite sides of the upper portion of the fuel chamber 152 are formed by flue members 184 and 186. Similar to the hearth elements 162 and 164, the flue elements 184 and 186 are identical, and only the element 186, also shown in FIGS. 15 and 16, will be described in further detail, it being understood that the element 184 responds exactly.

The flue element 186 butts against the top of the hearth element 164. The flue element 186 includes legs 188 which space the element 186 outwardly from the side of the fuel chamber 152 to permit combustion products from the tubes 178 to continue upwardly into a combustion products plenum 190 from which they are exhausted through a smoke pipe 192.

The combustion chamber 152 includes a normally-sealed top 194. In exactly the same manner as the earlier embodiments of the invention, this embodiment of the invention also includes a bypass damper 196 which may be opened by means of a push rod assembly 198 to initiate combustion within the fuel chamber 152. After combustion is begun, the bypass damper 196 is closed, as in the earlier embodiments of the invention.

For loading of fuel within the fuel chamber 152, a door 200 is provided in the front of the stove 150. A refractory liner 202 is provided to protect the metal of the door 200.

The entire combination of the fuel chamber 152 and plenum 190 is encased within an outer shell 204. The shell 204 is spaced from the fuel chamber 152 on all sides except the front (the left side of FIG. 11), to which it is attached. Thus, either by convection or by forced air methods, air can be circulated about the fuel chamber 152. In the particular embodiment shown in FIGS. 10 and 11, air is forced into the shell by a circulating air blower 206. Warm air exits through a warm air plenum 208 and may be directed as desired to locations to be heated.

In all embodiments of the invention, the fuel chamber is sealed with the exception of the lower combustion air inlet passage and the convergent outflow passage. During normal operation, a bed of incandescent coals densely bridges the slot of the convergent outflow passage and, as the coals are consumed, they are replaced by new coals. Logs in the fuel chamber descend directly by gravity onto the bed of coals. Ashes that form in the combustion zone migrate with the coals toward the convergent outflow passage. All products of combustion and ashes pass through the convergent outflow passage to either be exhausted to the atmosphere or captured in an ash receptacle for later removal.

Due to the geometry of the invention and the fact that the flow of the products of combustion is in the same direction as the flow of the fuel as it is converted to coals and then completely consumed, combustion is extremely efficient. Various changes can be made to the invention without departing from the spirit thereof or scope of the following claims.

What is claimed is:

1. An apparatus for burning combustible solid organic material such as wood in a environment in which combustion is directed downwardly, comprising a. a fuel chamber having a closed upper portion and a major dimension in the vertical direction such that said fuel chamber is generally upright, b. a combustion zone in the lower portion of said fuel chamber defined by a convergent outflow passage at the bottom of said fuel chamber and a pair of walls on opposite sides of said lower portion, said walls being sloped inwardly toward one another at said outflow passage, and said outflow passage comprising a gap between said walls, c. a hearth element forming each said sloping wall, said hearth element including i. at least one row of a plurality of spaced slots extending into the interior of said hearth element and a lateral air inlet channel connected to the slots of each row and a source of combustion air, and ii. a flue outlet communicating with said outflow passage, said flue outlet including a plurality of spaced, parallel tubes in said hearth element, with said tubes being juxtaposed said slots and extending perpendicular to said air inlet channels, d. means connected to said flue outlet to permit exhaustion of flue gases from said apparatus, and e. means for loading fuel into said fuel chamber.

2. An apparatus according to claim 1 in which the angle of slope of said sloped walls is a minimum of approximately 30°.

3. An apparatus according to claim 1 including means for controlling the flow of air through said air inlet channel.

4. An apparatus according to claim 1 in which said means for loading comprises a fuel loading door at the top of said upper portion.

5. An apparatus according to claim 1 including a normally closed bypass damper at the top of said upper portion to provide a temporary flue outlet from said fuel chamber such that combustion in said fuel chamber is directed upwardly.

6. An apparatus according to claim 1 in which said fuel chamber is located within a heat exchanger such that air adjacent said fuel chamber is heated by said fuel chamber, and including means to circulate air within said heat exchanger.

* * * * *